US010837146B2

(12) United States Patent
Nusca

(10) Patent No.: US 10,837,146 B2
(45) Date of Patent: Nov. 17, 2020

(54) INFILL MATERIAL FOR SYNTHETIC TURFS AND SYNTHETIC TURFS SO OBTAINED

(75) Inventor: Roberto Nusca, Arena Metato (IT)

(73) Assignee: MAR.PROJECT S.R.L., Pisa (IT)

( * ) Notice: Subject to any disclaimer, the term of this patent is extended or adjusted under 35 U.S.C. 154(b) by 243 days.

(21) Appl. No.: 13/392,643

(22) PCT Filed: Aug. 27, 2010

(86) PCT No.: PCT/IB2010/002122

§ 371 (c)(1),
(2), (4) Date: Mar. 14, 2012

(87) PCT Pub. No.: WO2011/024066

PCT Pub. Date: Mar. 3, 2011

(65) Prior Publication Data

US 2012/0189786 A1 Jul. 26, 2012

(30) Foreign Application Priority Data

Aug. 27, 2009 (IT) ..... PI2009A0107

(51) Int. Cl.
*E01C 13/08* (2006.01)
*B05D 1/36* (2006.01)

(52) U.S. Cl.
CPC ..... *E01C 13/08* (2013.01); *B05D 1/36* (2013.01); *D06N 2205/10* (2013.01);
(Continued)

(58) Field of Classification Search
CPC . E01C 13/08; D10B 2505/202; Y10S 273/13; B05D 1/36; Y10T 428/23921;
(Continued)

(56) References Cited

U.S. PATENT DOCUMENTS 7,943,212 B2 * 5/2011 Nusca et al. ..... 428/17
8,563,099 B2 * 10/2013 Gilardi ..... 428/22
(Continued)

FOREIGN PATENT DOCUMENTS

CN 105019332 A * 11/2015
EP 0 541 844 5/1993
(Continued)

OTHER PUBLICATIONS

Machine translation of JP 2003-034906 A, Nishikawa, 2003.*
Barker et al., "The Rice Economy of Asia," 1985, Resources for the Future, Inc., p. 175. (Year: 1985).*

*Primary Examiner* — Cheryl Juska
(74) *Attorney, Agent, or Firm* — Ladas & Parry LLP; Malcolm J. MacDonald

(57) ABSTRACT

Synthetic turf (1) comprising a mat (2) equipped with a first face (2*a*), which in use is arranged next to a surface (50) to coat, and with a second face (2*b*) opposite to the first face (2*a*). The synthetic turf (1) comprises, furthermore, a plurality of filaments (3) knitted to the mat (2) and made of a synthetic material. Above the second face (2*b*) of the mat (2), furthermore, an infill material (10) is present that is arranged all around the filaments (3) of artificial material. The infill material (10) comprises, in particular at least one layer (15) consisting of a mixture of a predetermined amount of cereal husks, such as rice husks, husks of wheat, husks of rye, husks of oat, husks of spelt, or a combination thereof, and of at least one defibrated arboreus material which is resistant to microbial digestion, such as a loose final product from raw material based on coir, or sawdust of a wood obtained by a raw material with high content of lignin, such as Teck sawdust, Mahogany sawdust, Iroko sawdust, or a combination thereof.

12 Claims, 4 Drawing Sheets

(52) U.S. Cl.
CPC ..... *D10B 2505/202* (2013.01); *Y10S 273/13* (2013.01); *Y10T 428/23921* (2015.04); *Y10T 428/23936* (2015.04); *Y10T 428/23957* (2015.04)

(58) Field of Classification Search
CPC .... Y10T 428/23936; Y10T 428/23957; D06N 2205/10
USPC ..... 428/87, 402
See application file for complete search history.

(56) References Cited

U.S. PATENT DOCUMENTS

| | | | | |
|---|---|---|---|---|
| 8,951,634 | B2 * | 2/2015 | Jung | E01C 13/08 428/326 |
| 2007/0248773 | A1 * | 10/2007 | Nusca et al. | 428/22 |
| 2008/0124496 | A1 * | 5/2008 | Avery | 428/17 |
| 2008/0299331 | A1 | 12/2008 | Gilardi | |
| 2010/0166984 | A1 * | 7/2010 | Nusca | 428/17 |
| 2011/0287263 | A1 * | 11/2011 | Jung | E01C 13/08 428/407 |
| 2012/0279125 | A1 * | 11/2012 | Nusca et al. | 47/66.7 |
| 2015/0084226 | A1 * | 3/2015 | Jung | E01C 13/08 264/115 |
| 2015/0141555 | A1 * | 5/2015 | Pun | C08L 99/00 524/14 |
| 2015/0252537 | A1 * | 9/2015 | Volterrani | E01C 13/08 47/1.01 F |

FOREIGN PATENT DOCUMENTS

| | | | | |
|---|---|---|---|---|
| EP | 2055834 | A1 * | 5/2009 | |
| GB | 399277 | A * | 10/1933 | C08L 97/02 |
| JP | 2003-34906 | | 2/2003 | |
| JP | 2007-205023 | | 8/2007 | |
| KR | 10-2009-0081862 | | 7/2009 | |
| KR | 10-0906622 | | 7/2009 | |
| KR | 101446458 | B1 * | 10/2014 | |
| WO | WO 2008115085 | A1 * | 9/2008 | |
| WO | WO 2008125895 | A1 * | 10/2008 | |

* cited by examiner

INFILL MATERIAL FOR SYNTHETIC TURFS AND SYNTHETIC TURFS SO OBTAINED

This application is a 371 of PCT/IB2010/002122, filed on Aug. 27, 2010, which claims priority to Italian Patent Application No. PI2009A000107, filed Aug. 27, 2009, and which is incorporated herein by reference.

FIELD OF THE INVENTION

The present invention relates to an infill material for a synthetic turf comprising organic material of vegetable origin, and it also relates to synthetic turfs so obtained.

BACKGROUND OF THE INVENTION

As well known, an artificial turf is essentially a mat of plastic material to which blades of synthetic material are connected in order to simulate a natural turf. The blades of synthetic material are knitted to the mat by means of known processes, in order to provide a warp of filaments, thick according to the needs. All around the blades of synthetic material an infill material is usually distributed, simply called infill, for example a layer of sand followed by a layer of granular synthetic or natural material.

According to the kind of sports and of the use to which the synthetic turf is destined, a suitable type of infill material is chosen (see for example Italian patent applications No. PI2001A000049 and No. PI2003A000036, in the name of the same applicant).

In particular, the infill material provides a draining action by adjusting the drainage of rainwater or of irrigation water; a protection of the mat; a high duration to the artificial turf; and especially gives to the turf mechanical, physic and technologic qualities typical of natural turfs.

Such qualities are, for example: the elasticity of the ground for the user, the rebound of the ball or other piece of equipment, capacity of absorption of the hits when falling down, tensile and torque resistance to the force caused by the shoe, resistance against compression and against penetration of external bodies, as well as capacity of absorption and drainage of water in case of rainfalls and irrigation.

For these reasons, the infill material of known type comprises a predetermined amount of sand, which is necessary for an effective drainage of the synthetic turf, and a predetermined amount of rubber material, usually granular, which gives to the synthetic turf the necessary physical and mechanical characteristics as above described, and, in particular, a high elasticity.

However, the rubber infill material used as above described is obtained mainly from waste material, such as ground spent tires, or in any case from a mixture of elastomers, and therefore it has a high content of toxic substances and potentially noxious both for the environment and for the people, such as heavy metals and solvents of various type.

Alternatively, granules of freshly prepared rubber are used in various chemical compositions, which are more expensive and in any case are difficult to dispose of at the end of the life of the turf in addition to a high cost.

The presence of such noxious substances in the rubber used as infill material represents, furthermore, an obstacle to dismantling spent synthetic turfs to be changed by a new synthetic turf.

Furthermore, the elastomeric material cannot retain much water and accumulate heat, such that in the hot seasons they create much more discomfort to the players than natural turfs.

JP2003034906 describes a synthetic turf comprising a support to which the artificial fibers are connected. Al around the artificial fibers an infill material is present. The infill comprises a lower layer consisting of rubber granules, in particular ground spent tires, and at least one upper layer of loose material. The loose material can be for example "chaff", sawdust, or other material having a light color, in such a way that it can reflect the sun light and avoid, then, an excessive heating of the turf. is, therefore, necessary that the layer of granular material makes up the upper part of the infill material, i.e. the layer that is arranged above the layer of ground spent tires. This is obtained using a granular material having a specific weight set between 0.3 and 1.

However, also the turf described in JP2003034906 has the drawbacks, above described, of fields involving waste material, such as ground spent tires, or a mixture of synthetic elastomers.

Another drawback of the solution described in JP2003034906 is that the upper layer, since it is very light, can be easily blown away by the wind. During a sports match this could hamper the players action, since it is not possible during the match to keep wet the upper layer.

In EP0541844 a artificial soil is described that can be used as growth substrate for cultivation of plants, for example, in golf courses. The artificial soil is highly resistant to vermin and virus and allows then reducing the use of pesticides and chemical products, which are commonly used in the cultivations made in natural soils. More in detail, the artificial soil comprises a layer of gravel, a layer of sand, and a layer consisting of an artificial soil for cultivation of plants. The artificial soil comprises a ground of cultivation for mushrooms in a ratio set between 60% and 80% by weight, in addition to a plurality of components among which sand, coal, mineral ore and chaff.

In the document no reference is made to the use of the artificial soil for making synthetic turfs.

SUMMARY OF THE INVENTION

It is therefore a feature of the present invention to provide an infill material for synthetic turfs that has not, or presents in an limited amount, rubber granules, and has in any case a high elasticity.

It is another feature of the present invention to provide an infill material for synthetic turfs that is much more biodegradable with time and more easily disposed of with respect to the infill presently known, containing large percentage of rubber granules.

It is a further feature of the present invention to provide an infill material for synthetic turfs that is made up, prevailingly, or completely, of natural vegetable material and is at the same time imputrescible and then not attackable by bacteria.

It is a particular feature of the present invention to provide an infill material for synthetic turfs that is non-flammable.

It is, furthermore, a feature of the present invention to provide an infill material for synthetic turfs that has a low retention of water and then capable of adjusting normal outflow of water through the synthetic turf.

It is a further feature of the present invention to provide an infill material for synthetic turfs that avoids the risk for light components to be blown away by the wind, and then to avoid hampering players during sports matches.

It is a further feature of the present invention to provide an infill material for synthetic turfs that presents a high elasticity and then achieves a technical quality comparable and even higher than a synthetic infill which uses the rubber as infill material.

These and other features are accomplished with one exemplary infill material, according to the invention, for synthetic turfs whose main feature is that it comprises a mixture of:

- a measured amount of a defibrated arboreus material which is resistant to microbial digestion;
- a measured amount of cereal husks.

Advantageously, the defibrated arboreus material which is resistant to microbial digestion is a loose final product from raw material based on coconut coir.

Alternatively, the defibrated arboreus material which is resistant to microbial digestion is obtained by sawdust obtained by a raw material with high content of lignin, in particular selected from the group comprised of:

- Teck sawdust;
- Mahogany sawdust;
- Iroko sawdust;

In particular, the defibrated arboreus material which is resistant to microbial digestion, for example coir, in the presence of moisture creates a three-dimensional reticular pulp that holds the lighter parts such as the cereal husks "trapping them" and avoiding that they can get free from the turf infill and scatter in the environment. This makes it possible to exploit fully the physical characteristics of the cereal husks, in particular its high elasticity, and to avoid at the same time that it can hamper players during sports matches. Furthermore, the cereal husks have a shell-like shape, which gives to the mixture a high void ratio.

The cereal husks, or chaff, is a by-product deriving the work of the cereals and is formed by the bracts, or glumelle, which encircle the raw kernel after the threshing.

In particular, the cereal husks can be selected from the group comprised of:

- rice husks;
- husks of wheat;
- husks of rye;
- husks of oat;
- husks of spelt;
- or a combination thereof.

Preferably, the cereal husks comprise rice husks, which have a high rate of elasticity against bending of the hulls. In particular, the cereal husks substantially lens-shaped comprising concave portions and convex portions with rather high concavity. For these particular morphological features the cereal husks, and, in particular, the rice husks, occupy a high volume, but have a high void ratio. Thus, on the one hand a high elasticity is achieved and on the other hand a high draining action is achieved by the mixture that contains them.

In particular, the cereal husks can be present in said mixture in a percent volume set between 1% and 15%.

Advantageously, the cereal husks present in said mixture in a percent volume set between 1% and 10%. For example, the percent volume of the cereal husks with respect to the overall volume of the mixture can be about the 6%.

In particular, the matrix consisting of the defibrated arboreus material which is resistant to microbial digestion is capable of keep a limited amount of cereal husks. More precisely, cereal husks higher than the 15-20% v/v are not held by the matrix with the above described drawbacks.

Advantageously, said mixture comprises, furthermore, a predetermined amount of a loose final product obtained from raw material based on ground cork. This way, mixing the ground cork to the cereal husks and to the defibrated arboreus material which is resistant to microbial digestion, the physical characteristics of the infill material are further improved. In particular, the presence of the cork increases further the elasticity of the synthetic turf and then of improving the athletes performances.

Advantageously, the infill material comprises, furthermore, a predetermined amount of sand.

For example, said mixture can comprise a predetermined amount of sand.

In an exemplary embodiment of the invention the infill material can comprise:

- a lower layer of sand, in particular, said layer of sand have a volume set between 5% and 60% of the overall volume of said infill material;
- an upper layer consisting of said mixture.

In particular, the layer of sand can be present in a volume set between 8% and 30% of the overall volume of the infill material.

In particular, the sand has a granulometry set between 0.4 mm and 2.0 mm.

In particular, the defibrated arboreus material which is resistant to microbial digestion is present in said mixture in a percent volume set between 40% and 95%, Advantageously between the 65% and 85% v/v.

In particular, the measured amount v/v of the cork present in the mixture of loose material of vegetable natural origin is set between 15% and 40% v/v, Advantageously, set between 20% and 35% v/v.

Advantageously, the mixture of loose material of vegetable natural origin has the following composition:

- between about 1% to about 15%, in particular between 1% and 10%, v/v of cereal husks, in particular rice husks;
- between about 20% and about 35%, in particular between about 20% and about 25%, v/v of cork, in particular of ground cork;
- between about 55% and 80%, in particular between about 65% and about 75%, of defibrated arboreus material which is resistant to microbial digestion, in particular loose material based on coconut coir.

Preferably, the cereal husks have a moisture set between 5% and 15%.

In particular, the loose final product from raw material based on coconut ground comprises the sole granular and fibrous part contained in the starting raw material based on coconut. For example, the granular and fibrous part can be obtained putting the raw material starting through a separation step of the granular and fibrous part from the powder in it present.

Advantageously, the granular and fibrous part contained in the starting loose product is separated by sieving the raw material based on coconut coir.

Preferably, the granular and fibrous part of coconut ground has a grain size larger than 500 micron (μm) for 90% by weight.

Advantageously, the sieving of the loose material is carried out by a sieving means selected from the group comprised of:

- a mechanical sieve, in particular a rotating sieve, a vibrating sieve, etc.
- an electromagnetic sieve.

Advantageously, the granular and fibrous part has the following grain size:

- among 20% and 40% by weight set between 0.8 mm and 1.25 mm;

among 15% and 35% by weight set between 1.25 mm and 1.60 mm;

among 50% and 70% by weight larger than 1.6 mm.

According to another aspect of the invention, a synthetic turf for sports or recreational activities comprises:

a mat equipped with a first face that is adapted to be arranged on a surface to coat and with a second face opposite to the first face;

a plurality of filaments of synthetic material knitted on said mat, said plurality of filaments of synthetic material protruding from said second side in order to form a turf;

an infill material for said turf, said infill material comprising a loose material of vegetable origin, said loose material of vegetable origin being a mixture of:

a measured amount of a defibrated arboreus material which is resistant to microbial digestion;

a measured amount of cereal husks.

Advantageously, the filaments of synthetic material knitted on said mat comprises:

a first group of longer filaments, said first group of filaments protruding from said infill material;

a second group of shorter filaments, said second group of filaments arranged within the infill material without protruding from it, or protruding minimally from it, for example of 2-5 mm.

In particular, the filaments of the first group of filaments protrude from the infill material about 10-15 mm.

The second group of filaments may have twisted shape in order to give higher support to the infill material.

According to a further aspect of the invention, a method for making a synthetic turf comprises the steps of:

preparing a turf comprising a mat to which a plurality of filaments of synthetic material is connected, said mat equipped with a first face that is adapted to be arranged on a surface to coat and with a second face opposite to the first face, said plurality of filaments of synthetic material protruding from said second face;

laying on said first face of said mat an infill material obtaining a synthetic turf, said infill material comprising a loose material of vegetable origin, said loose material of vegetable origin being a mixture of:

a measured amount of a defibrated arboreus material which is resistant to microbial digestion;

a measured amount of cereal husks.

In particular, the step of distributing said infill material comprising the steps of:

distributing a layer of sand on said mat;

distributing a layer consisting of said mixture on said layer of sand.

Advantageously, the layer of sand has a volume set between 5% and 55% of the overall volume of said infill material.

In an exemplary embodiment, the infill material can comprise, furthermore, a predetermined amount of sand mixed to the rice husks and/or to the cork and/or to the coconut coir.

BRIEF DESCRIPTION OF THE DRAWINGS

The invention will be made clearer with the following description of an exemplary embodiment thereof, exemplifying but not limitative, with reference to the attached drawings in which.

Figure 1:
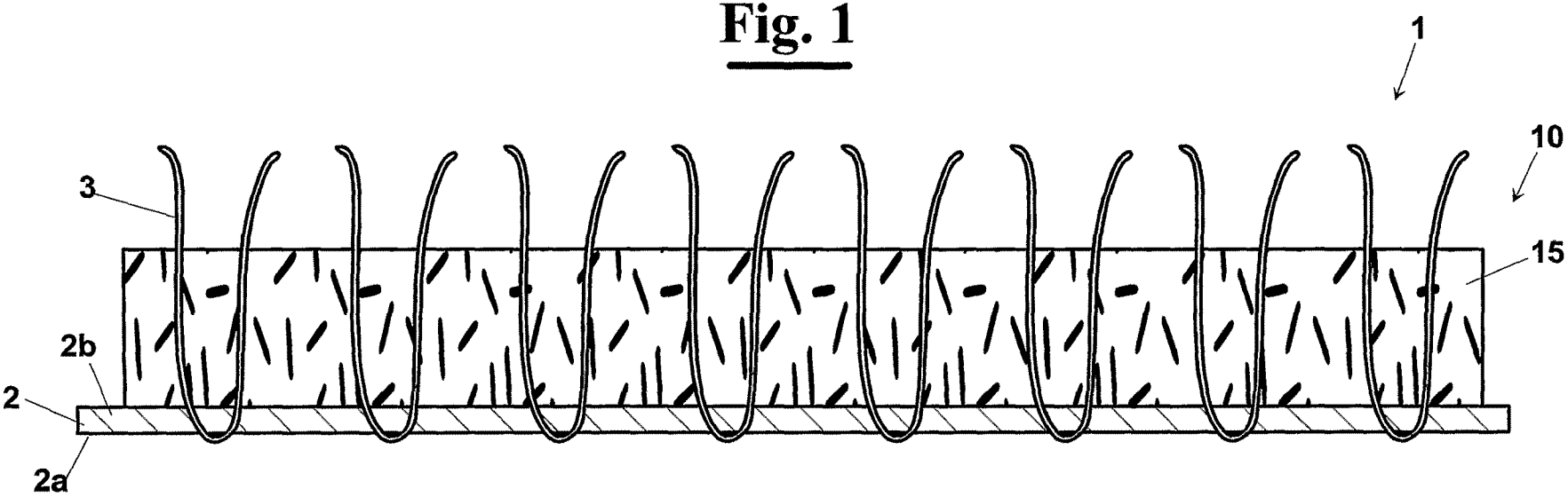
FIG. 1 diagrammatically shows a cross sectional view of a first exemplary embodiment of an infill material for synthetic turfs, according to the invention.

figures from 2 to 4 show diagrammatically transversal cross sections of some exemplary embodiments of the infill material for synthetic turfs of FIG. 1.

DESCRIPTION OF SOME PREFERRED EXEMPLARY EMBODIMENTS

With reference to FIG. 1, a synthetic turf 1, according to the invention, comprises a mat 2 equipped with a face 2*a*, which in use is arranged next to a surface 50 to coat, and a face 2*b* opposite to face 2*a*. The synthetic turf 1 comprises, furthermore, a plurality of filaments 3 knitted to mat 2 and made of a synthetic material. above face 2*b* of mat 2, furthermore, an infill material 10 is present all around the filaments 3 of artificial material.

According to the invention and as shown in FIG. 1, the infill material 10 comprises at least one layer 15 consisting of a mixture of at least one measured amount of a defibrated arboreus material which is resistant to microbial digestion and of a predetermined amount of cereal husks. For example, the cereal husks can be rice husks, husks of wheat, husks of rye, husks of oat, husks of spelt, or a combination thereof. In particular, the husks comprise a by-product deriving from cereal transformation and is the set of the bracts, or hulls, which enclose the kernel. More precisely, in case of cereal such as wheat and rye, the husks do not adhere to the kernel, also called caryopsis, and therefore their separation is carried out directly during the threshing. In case of cereals like rice, oat and spelt that have, instead, husks stuck to the kernel have to be semi-milled by two horizontal discs, so-called hullers, coated with abrasive material through which the kernel is decorticated removing the husks and the glumelle. The waste deriving from semi-milling for example from brown rice, i.e. from raw rice, after threshing, gives origin to the husks known also as rice hull, or rice chaff.

The cereal husks, and, in particular, the rice husks, have a high elasticity against bending of the hulls. More in detail, the cereal husks are substantially lens-shaped comprising concave portions and convex portions with rather high concavity. For these particular morphological features the cereal husks, and, in particular, the rice husks, occupy a high volume, but have a high void ratio. from which on the one hand a high elasticity derives and on the other hand a high draining action is achieved by the mixture that contains them.

The defibrated arboreus material which is resistant to microbial digestion can be, instead, a loose final product of raw material based on coir, or alternatively, sawdust of a wood obtained from a raw material with high content of lignin, such as Teck sawdust, Mahogany sawdust, Iroko sawdust, or a combination thereof. In particular, the above described defibrated arboreus material which is resistant to microbial digestion, in the presence of humidity form a three-dimensional reticular pulp that holds the lighter parts of infill material 10, in particular the cereal husks, "trapping them" and avoiding that they can get free from the turf infill and scatter in the environment. This makes it possible to exploit fully the physical characteristics of the cereal husks, in particular its high elasticity, and to avoid at the same time that it can hamper players during sports matches.

The infill material 10 can also comprise a predetermined amount of a loose final product from raw material based on ground cork. This way, mixing the ground cork to the cereal husks and to the defibrated arboreus material which is resistant to microbial digestion the physical characteristics of the infill material are further improved.

In an exemplary embodiment, the infill material 10 has a composition comprising between about 1% and about 15% v/v of cereal husks, between about 55% and 85% of raw material based on coconut ground and between about 20% and 35% of ground cork. The infill material 10 can comprise, furthermore, a predetermined amount of selected sand with controlled grain size, for example set between 0.4 mm and 2.0 mm.

Figure 2:
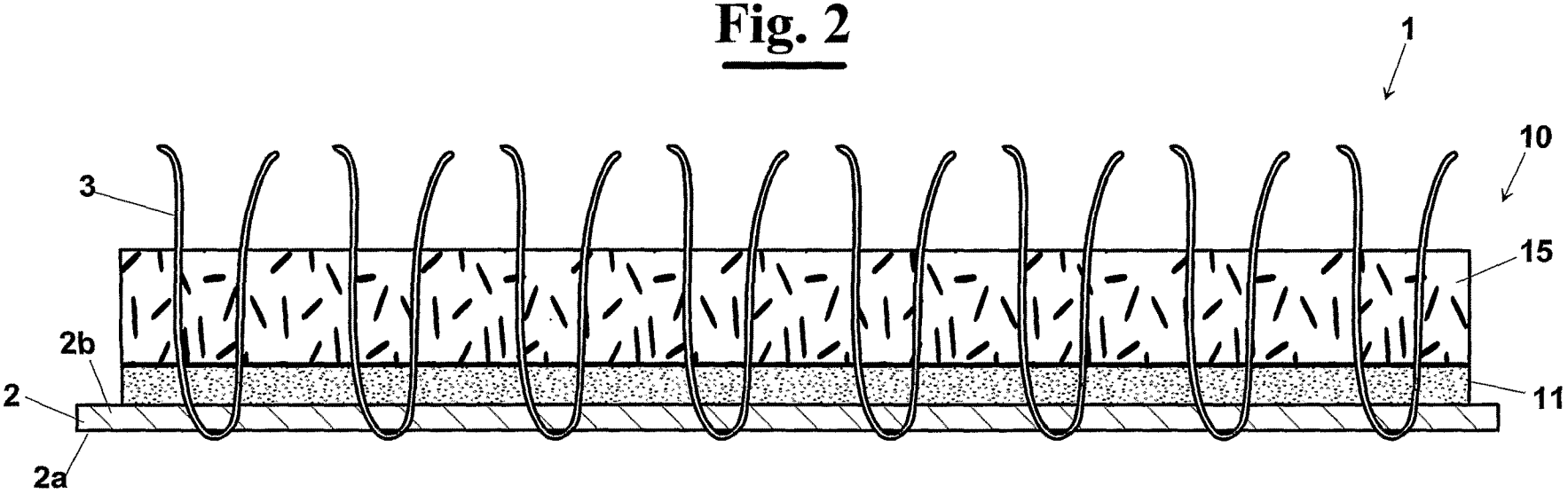

In the exemplary embodiment shown in FIG. 2, the infill material 10 is made distributing a layer of sand 11 on face 2*b* of mat 2 before laying layer 15 consisting of the above described mixture of loose material of vegetable natural origin.

Figure 3:
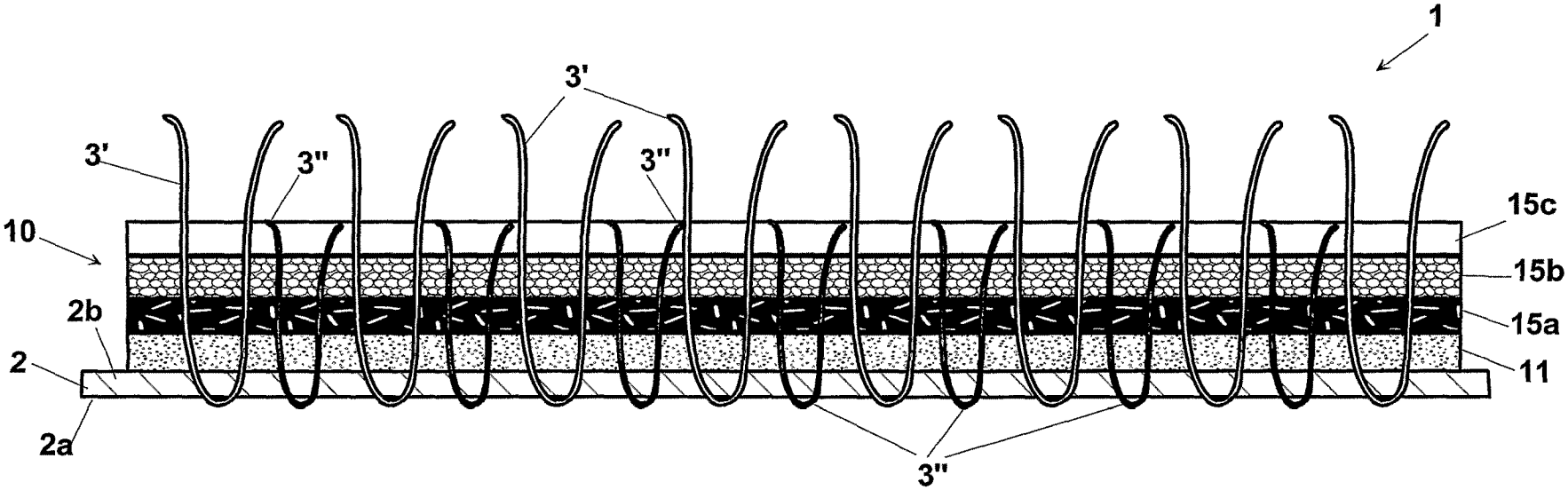

In the exemplary embodiment of FIG. 3, the infill material 10 is obtained distributing in turn four layers of different material. In particular, a first layer 11 of sand and three layers 15*a*-15*c*, at least one of which consisting of a mixture of cereal husks with at least one defibrated arboreus material which is resistant to microbial digestion.

For example, above the layer 11 of sand a layer of cork 15*a* is distributed, above which a layer of cereal husks 15*b* is made mixed to a loose product based on coconut. Furthermore, a further layer 15*c* can be provided comprising about exclusively a loose product based on coconut coir.

In the two exemplary embodiments above described the layer of sand 11 has draining function and is, furthermore, capable of adjusting the microclimate of the synthetic turf 1. The infill material 10 has, instead, mainly the function of adjusting the outflow and the drainage of the rainwater, or irrigation water, and to ensure a suitable rate of moisture of the playground.

As above described, the presence of the rice husks confers to the synthetic turf 1 appropriate physical and mechanical characteristics, necessary for the sports or recreational activities. The rice husks has, in fact, a high elasticity both if they are entire and fragmented. Furthermore, the rice husks ensure a correct drainage of water from the turf infill owing to a reduced water retention, allowing an adjustment of the outflow of water from the synthetic turf 1.

Figure 4:
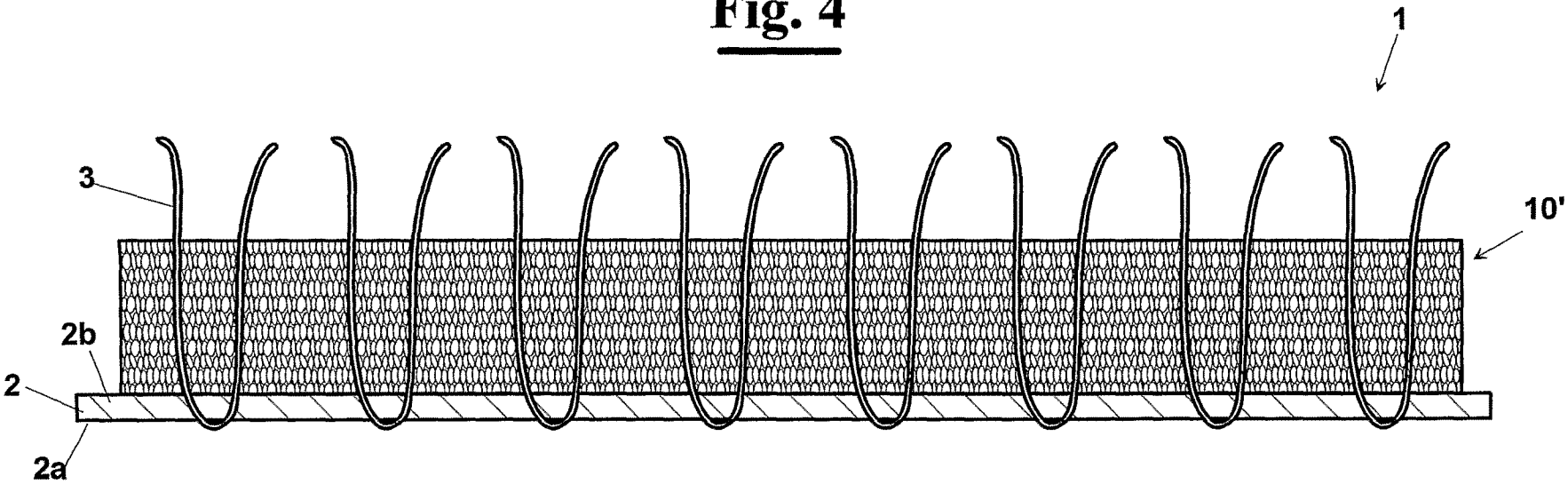

In a further exemplary embodiment shown in FIG. 4, the infill material 10' provides a single heterogeneous layer consisting of a mixture of sand, cork, rice husks and loose product based on coconut ground in a determined percentage v/v. Even in this case the sand, even if mixed with the other components making up the infill material, carries out an effective draining action that avoids flooding the synthetic turf in case of strong rainfall.

As shown, for example in FIG. 3, the filaments 3 of synthetic material knitted on mat 2 can comprise at least one first group of longer filaments 3', which protrude from the infill material 10 and at least one second group of filaments 3", shorter, in order to result within the infill material 10 without protruding from it, or protruding minimally from it, for example 2-3 mm. This second group of filaments 3" may have twisted shape in order to confer higher support to the infill material 10.

The following are not limitative examples of the components of the infill material, according to the invention:

1) Sand
   Composition: siliceous sand and/or quartz with single, or aggregate crystal quartz.
   Minimum content of SiO2: 70%
   Physical state: solid
   Form: crystalline
   pH: 5÷8
   Grain size: 0.4-0.9 mm
   Density: 1500-1700 kg/m$^3$ 2) Organic material of vegetable origin:
   Composition: Vegetable natural material deriving from defibrated arboreus plant parts, biodegradable, free from extraneous material:
   Form: irregular
   Color: brown
   Odor: odorless
   Grain size: 1÷2 mm
   pH: 5.0÷6.5
   Electric conductivity: 0.63 uS/cm to 25° C.
   Content of moisture: 5.0/20.0%.

3) Rice husks:
   Composition: the husks or chaff of rice, or also hulls is the waste deriving from the semi-milling of the brown rice, the raw rice obtained after threshing. The ratio of the husks on the raw rice changes according to the variety, and is set between 17 and 23 percent.
   Colour: brown-beige,
   Consistency: hard,
   Density: 132÷140 kg/m$^3$,
   Features: imputrescible and not attackable by insects,
   Composition:
      proteins: 3.3%
      fats: 1.1%
      cellulose: 45%,
      ashes: 17%,
   average calorific value: 14 MJ/kg.

4) Loose product of raw material based on coconut coir:
   Grain size: larger than 500 micron (μm) for 90% by weight, Furthermore, hereafter a table is indicated of a standard composition of infill material, according to the invention.

| | Percent volume | |
|---|---|---|
| Component | min | max |
| Loose product based on coconut coir | 55% | 85% |
| Rice husks | 1% | 15% |
| Ground cork | 15% | 35% |
| Siliceous sand | 0% | 30% |

In particular, the composition of the infill material given in the table can be adjusted within the range indicated responsive to the type of weaving and of density of the filaments (tufting), of the fibers used for making the synthetic turf, as well as responsive to the environmental features and of the ground that bears the turf, providing a customized distribution of the three components.

The infill material can be subject to changes concerning the succession of layers of the material, or the possible mixing of two, or all the components. For each specific case of stratification and succession, or mixing, of the material in any case is preferable to respect the percentage by weight of each element as indicated in the table 1 relative to a standard infill material standard.

EXAMPLE an infill for artificial soccer fields, comprising a layer of sand of about 8% v/v of siliceous sand and 92% of vegetable natural material.

The vegetable natural material comprises 6% rice husks, 22% ground cork and 72% coconut coir from which the powder part has been removed.

A similar composition, with about 6% of rice husks, about 22% ground cork and about 72% of coconut coir from which the powder part has been removed has been used successfully also with different proportions of sand from the above indicated range, and even without sand.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realize the different functions described herein could have a different nature without, for this reason, departing from the field of the invention. It is to be understood that the phraseology or terminology employed herein is for the purpose of description and not of limitation.

The invention claimed is:

1. An infill material installed on a synthetic turf, the infill material consisting of:

a lower layer of sand having a volume set between 8% and 30% of the overall volume of the infill material, the sand having a size set between 0.4 mm and 2.0 mm;

an upper layer consisting of a mixture obtained by mixing:

between 1% and 10% in a percent volume of cereal husks selected from the group consisting of rice husks, oat husks, spelt husks, and combinations thereof;

between 55% and 80% in a percent volume of a loose product from raw material based on coconut coir, which is resistant to microbial digestion, and which forms, in the presence of moisture, a three-dimensional reticular structure trapping the cereal husks within, and preventing release of the cereal husks from the synthetic turf, wherein the size of the loose product from raw material based on coconut coir is larger than 500 μm for 90% by weight obtained by sieving a starting raw material based on coconut; and between 15% and 40% in a percent volume of a loose final product from raw material based on ground cork up to a total percentage volume of 100% of the mixture.

2. A synthetic turf consisting of:

a synthetic mat having a substrate from which synthetic grass filaments project, an infill material, according to claim 1.

3. The infill material according to claim 1, wherein said raw material based on coconut coir is present in a percent volume of between 65% and 85%.

4. The infill material according to claim 1, wherein said cereal husks have a moisture content of between 5% and 15%.

5. The infill material according to claim 1, wherein said loose product from raw material based on coconut coir obtained by sieving has the following grain size:

among 20% and 40% by weight is between 0.8 mm and 1.25 mm;

among 15% and 35% by weight is between 1.25 mm and 1.60 mm; and among 50% and 70% by weight is larger than 1.6 mm.

6. The infill material according to claim 1, wherein said loose final product from raw material based on ground cork is present in a volume of between 20% and 35% of the overall volume of said infill material.

7. The infill material according to claim 1, wherein the percent volume of the cereal husks with respect to the total volume of the mixture is about 6%.

8. A synthetic turf for sports or recreational activities comprising a synthetic mat having a substrate from which synthetic grass filaments project, comprising an infill material according to claim 1.

9. The synthetic turf according to claim 8, wherein said synthetic grass filaments comprise:

a first group of longer filaments, said first group of filaments protruding from said infill material; and a second group of shorter filaments, said second group of filaments arranged within the infill material without protruding from it, or protruding minimally from it.

10. The synthetic turf according to claim 9, wherein said filaments of said second group of filaments has a twisted shape.

11. A method for making a synthetic turf comprising the steps of:

preparing a synthetic mat having a substrate from which synthetic grass filaments project;

distributing, on said mat, an infill material obtaining a synthetic turf;

said infill material consisting of:

a lower layer of sand having a volume set between 8% and 30% of the overall volume of the infill material, the sand having a size set between 0.4 mm and 2.0 mm;

an upper layer consisting of a mixture obtained by mixing:

between 1% and 10% in a percent volume of cereal husks selected from the group consisting of rice husks, oat husks, spelt husks, and combinations thereof, wherein said cereal husks are obtained by subjecting a cereal to a semi-milling process carried out by two horizontal discs coated with an abrasive material;

between 55% and 80% in a percent volume of a loose product from raw material based on coconut coir, which is resistant to microbial digestion, and which forms, in the presence of moisture, a three-dimensional reticular structure trapping the cereal husks within, and preventing release of the cereal husks from, the synthetic turf, wherein the size of the loose product from raw material based on coconut coir is larger than 500 μm for 90% by weight obtained by sieving a starting raw material based on coconut, and between 15% and 40% in a percent volume of a loose final product from raw material based on ground cork up to a total percentage volume of 100% of the mixture.

12. The method according to claim 11, wherein the loose product from raw material based on coconut coir is obtained by sieving a starting raw material based on coconut, up to a grain size larger than 500 μm for 90% by weight.

* * * * *